US007204732B2

(12) United States Patent
Mizuguchi

(10) Patent No.: US 7,204,732 B2
(45) Date of Patent: Apr. 17, 2007

(54) OUTBOARD MOTOR

(75) Inventor: Hiroshi Mizuguchi, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 0 days.

(21) Appl. No.: 11/205,692

(22) Filed: Aug. 17, 2005

(65) Prior Publication Data

US 2006/0040572 A1 Feb. 23, 2006

(30) Foreign Application Priority Data

Aug. 23, 2004 (JP) ..... 2004-242497

(51) Int. Cl.
*B63H 21/30* (2006.01)

(52) U.S. Cl. ..... 440/52

(58) Field of Classification Search ..... 440/52
See application file for complete search history.

(56) References Cited

U.S. PATENT DOCUMENTS

| | | | | |
|---|---|---|---|---|
| 2,909,031 | A * | 10/1959 | Kiekhaefer | 440/52 |
| 3,002,489 | A * | 10/1961 | Watkins | 440/52 |
| 3,934,537 | A | 1/1976 | Hall | |
| 4,583,953 | A * | 4/1986 | Nakase | 440/52 |
| 5,149,284 | A | 9/1992 | Kawai | |
| 6,645,019 | B1 * | 11/2003 | Shiomi et al. | 440/52 |
| 6,656,003 | B1 * | 12/2003 | Kitsu et al. | 440/52 |

FOREIGN PATENT DOCUMENTS

| | | |
|---|---|---|
| CA | 1039590 | 10/1978 |
| CA | 2384979 | 11/2004 |
| JP | 5278684 | 10/1993 |
| JP | 10-016887 | 1/1998 |

OTHER PUBLICATIONS

Lin and Huang; Survey Of Development And Application Of Highly Flexible Couplings On Ships, Journal Of Naval University Of Engineering, Apr. 2001-vol. 13- No. 2, Wuhan 43003, China.

* cited by examiner

*Primary Examiner*—Lars A. Olson
(74) *Attorney, Agent, or Firm*—Carrier, Blackman & Associates, P.C.; Joseph P. Carrier; William D. Blackman

(57) ABSTRACT

An outboard motor adapted to be mounted on a stern of a boat includes an internal combustion engine installed on a frame and a propeller powered by the engine to propel the boat, elastic members (rubber vibration isolators, elastic couplings, etc.) are interposed between the engine and the frame, thereby enabling vibration and noise produced by engine operation to be reduced without degrading steering performance.

10 Claims, 2 Drawing Sheets

OUTBOARD MOTOR

BACKGROUND OF THE INVENTION

1. Field of the Invention

This invention relates to an outboard motor, particularly to an outboard motor configured for reducing vibration and noise produced during engine operation.

2. Description of the Related Art

Outboard motors equipped with an internal combustion engine for driving a propeller are in wide use. In this type of outboard motor, the engine, which is oriented with its crankshaft parallel to the vertical direction, is mounted directly on the frame of the outboard motor. In the prior art, vibration and noise generated during engine operation is usually reduced by interposing elastic members made of rubber or the like between the outboard motor mounting assembly (mechanism for fastening the outboard motor to a hull (boat)) and the outboard motor proper, as taught, for example, in Japanese Laid-Open Patent Application No. Hei 5(1993)-278684, e.g., paragraphs 0009, 0015, 0016, FIG. 1, etc.

However, when the prior art of inserting elastic members between the outboard motor mounting assembly and the outboard motor proper is adopted, the steering performance of the outboard motor may be degraded if elastic members that are too low in hardness or stiffness (i.e., too soft) are used. Specific problems encountered include degraded response and wandering. The range of selectable elastic member hardness is therefore limited (to ones of a certain level required to avoid steering performance degradation). As a result, outboard motor vibration cannot be sufficiently reduced.

In the prior art, the mounting of the engine directly on the outboard motor frame allows engine vibration to pass to the outboard motor frame, and the resonation of the frame amplifies the vibration and noise of the outboard motor.

SUMMARY OF THE INVENTION

An object of this invention is therefore to overcome this problem by providing an outboard motor that enables vibration and noise produced by engine operation to be reduced without degrading steering performance.

In order to achieve the object, this invention provides an outboard motor adapted to be mounted on a stern of a boat and having an internal combustion engine and a propeller that is powered by the engine to propel the boat, comprising a frame on which the engine is installed such that a crankshaft of the engine is parallel to a vertical axis, and an elastic member interposed between the engine and the frame.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

An embodiment of the outboard motor according to the invention will now be explained with reference to the attached drawings.

Figure 1:
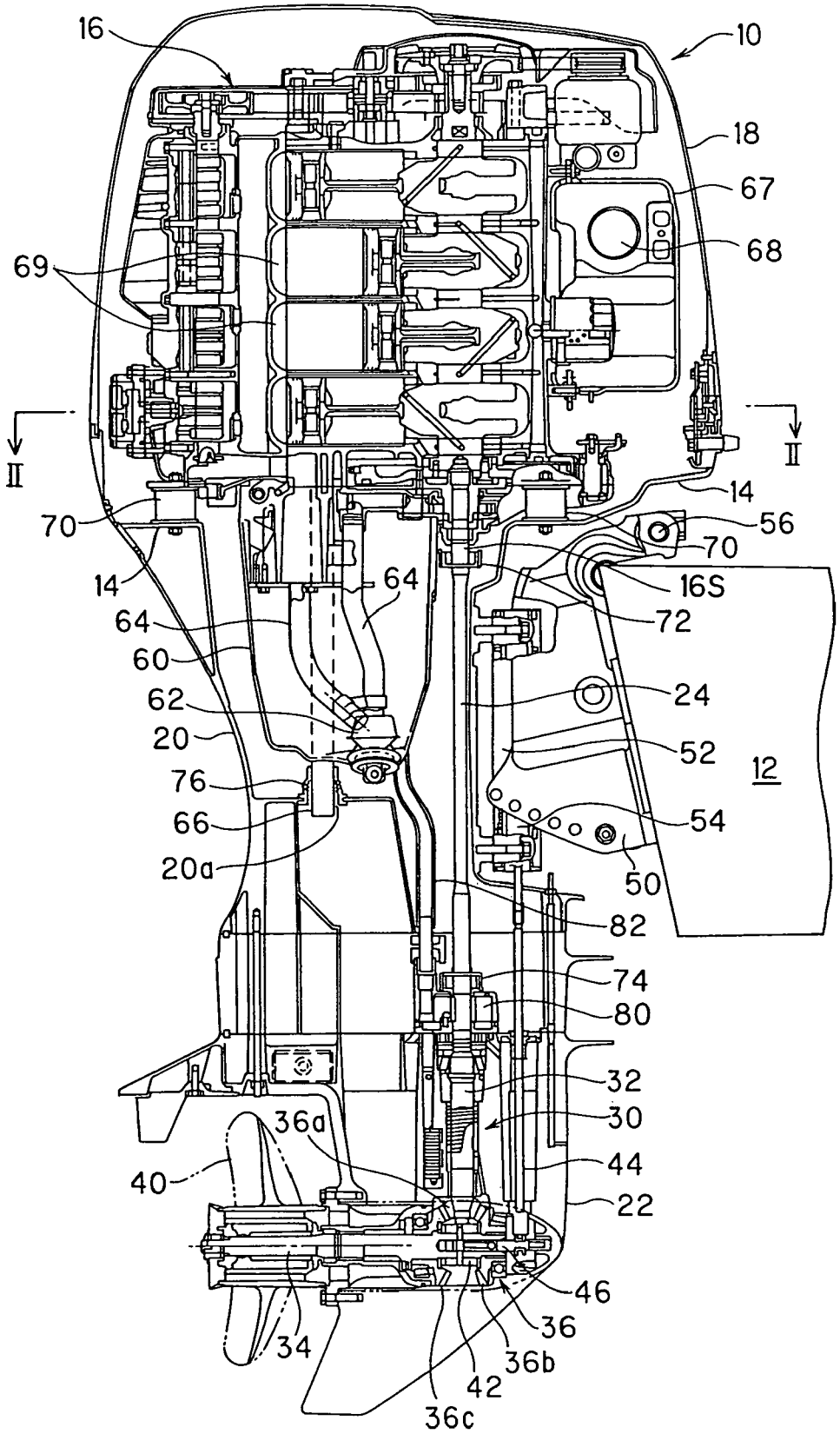
FIG. 1 is a sectional side view of an outboard motor according to a preferred embodiment of this invention.

FIG. 1 is a sectional side view of an outboard motor according to a preferred embodiment of this invention.

The outboard motor of this embodiment is designated by the symbol 10 in the drawing. The outboard motor 10 is mounted on the stern of a hull (boat) 12 by means of a mounting assembly (explained later). The outboard motor 10 is equipped with a mount case 14 on which an internal combustion engine 16 is mounted. The engine 16 is mounted on the mount case 14 with its crankshaft 16S oriented parallel to the vertical direction and is enclosed by an engine cover 18. The engine 16 is a spark-ignition gasoline engine with a displacement of around 2000 cc.

An extension case 20 is fastened to the bottom of the mount case 14 by bolts (not shown). A gear case 22 is fastened to the bottom of the extension case 20 by bolts (not shown). The frame of the outboard motor 10 comprises the mount case 14, extension case 20 and gear case 22. These three members are made wholly of metal, typically aluminum.

The crankshaft 16S of the engine 16 is connected to the upper end of a vertical shaft 24 oriented parallel to the vertical direction. The lower end of the vertical shaft 24 is connected to a rotary transmission mechanism 30 that is supported by the gear case 22.

The rotary transmission mechanism 30 includes a drive shaft 32 oriented parallel to the vertical direction, a propeller shaft 34 oriented parallel to the horizontal direction, and a gear mechanism 36 connecting the drive shaft 32 and propeller shaft 34. Among these, the drive shaft 32 has its upper end connected to the lower end of the vertical shaft 24. A propeller 40 is attached to the distal end of the propeller shaft 34.

The vertical shaft 24 is rotated about its vertical axis by the output of the engine 16. The rotation of the vertical shaft 24 is transmitted through the drive shaft 32 to the gear mechanism 36, where it is converted into rotation around a horizontal axis and transmitted through the propeller shaft 34 to the propeller 40.

The gear mechanism 36 comprises a pinion gear 36*a*, a forward bevel gear 36*b* engaged with the pinion gear 36*a* and rotating in one direction, and a reverse bevel gear 36*c* also engaged with the pinion gear 36*a* and rotating in the other direction opposite from the forward bevel gear 36*b*.

A clutch 42 is installed between the forward bevel gear 36*b* and reverse bevel gear 36*c*. The clutch 42 is attached to a rotating shaft of the propeller 40, namely, the propeller shaft 34. By manipulating a shift rod 44 to slide a shift slider 46, the clutch 42 can be brought into engagement with either the forward bevel gear 36*b* or the reverse bevel gear 36*c*.

Therefore, when the shift rod 44 is manipulated to engage the clutch 42 with the forward bevel gear 36*b* or the reverse bevel gear 36*c*, the rotation of the drive shaft 32 is converted to rotation about the horizontal axis and transmitted to the propeller shaft 34. The propeller 40 is therefore rotated about its horizontal axis to propel the boat 12 forward or rearward. In this manner, the engine 16 provided in the outboard motor 10 serves as a drive source for the propeller 40.

The outboard motor 10 comprises stern brackets 50 fastened to the stern of the boat 12, a swivel case 52 attached to the stern brackets 50, and a swivel shaft 54 accommodated in the swivel case 52. The mounting assembly of the outboard motor 10 comprises the stern brackets 50, swivel case 52 and swivel shaft 54.

The swivel shaft 54 is rotatably housed in the swivel case 52. The upper end of the swivel shaft 50 is fastened to the mount case 14 and the lower end thereof is fastened to the extension case 20. In addition, the swivel case 52 is rotatably connected to the stern brackets 50 through a tilting shaft 56. As a result, the outboard motor 10 can be swung around the swivel shaft 54 to steer it left and right relative to the boat 12 and can be lifted around the tilting shaft 56 to tilt or trim it up and down.

An oil pan 60 is integrally attached to the bottom of the engine 16. A strainer 62 and oil lines 64 are disposed inside the oil pan 60. Lubricating oil contained in the oil pan 60 passes through the strainer 62 and oil lines 64 to be circulated inside the engine 16.

An air intake pipe (not shown) and an exhaust pipe 66 are integrally attached to the engine 16. The lower end of the exhaust pipe 66 is fitted into a hole 20*a* formed in the extension case 20.

Air drawn into the air intake pipe and regulated in flow rate by a throttle valve 68 in a throttle body 67 flows through an intake manifold (not shown) and is mixed with fuel injected from an injector (not shown) in the vicinity of intake valves (not shown), thereby producing an air-fuel mixture.

The air-fuel mixture drawn into the combustion chamber 69 of each cylinder of the engine 16 is ignited and burned, and the resulting exhaust gas passes through an exhaust valve and an exhaust manifold (neither shown), whereafter it is discharged from the exhaust pipe 66 into the interior of the extension case 20. The exhaust gas discharged into the interior of the extension case 20 further passes through the gear case 22 to be discharged to outside the outboard motor 10.

As will now be explained in detail, a characterizing feature of this invention is that a plurality of rubber vibration isolators (elastic members) 70 are interposed between the engine 16 and the mount case 14.

Figure 2:
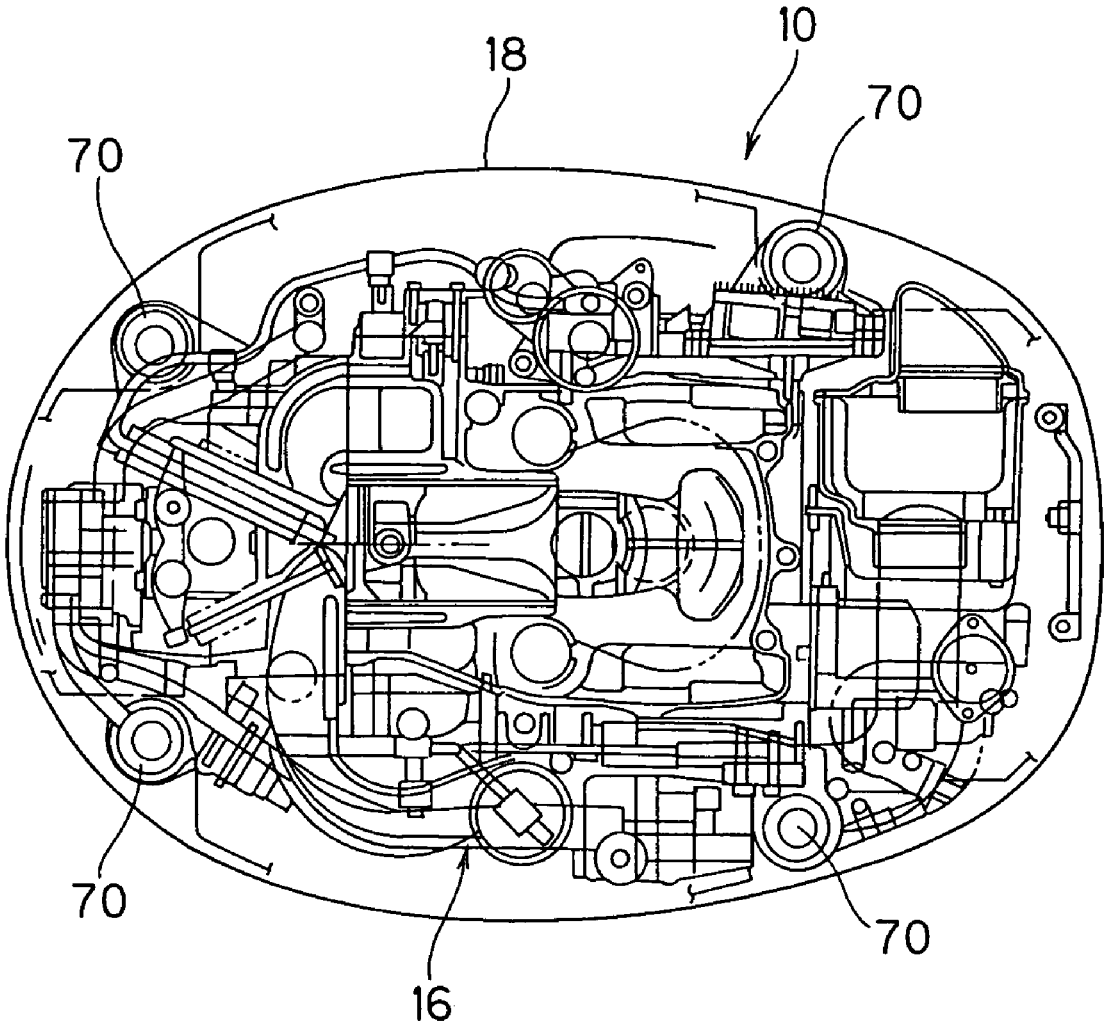
FIG. 2 is a sectional view taken along line II—II in FIG. 1.

FIG. 2 is a sectional view taken along line II—II in FIG. 1.

As shown in FIG. 2, four rubber vibration isolators 70 are inserted at the four corners of the engine 16. The rubber vibration isolators 70 are made of chloroprene rubber having a hardness or stiffness (in other words, elasticity) of a value (e.g., around HS 60°) capable of suppressing the transmission of vibration produced by the engine 16 to the mount case 14.

As shown in FIG. 1, the crankshaft 16S and the upper end of the vertical shaft 24 are connected by a first rubber coupling (first elastic coupling (shaft coupling)) 72. Further, the lower end of the vertical shaft 24 and the rotary transmission mechanism 30 (more exactly, the drive shaft 32) are connected by a second rubber coupling (second elastic coupling (shaft coupling)) 74.

The first rubber coupling 72 and second rubber coupling 74 are made of chloroprene rubber which, like that of the rubber vibration isolator 70, has a hardness (elasticity) of a value (e.g., around HS 60°) capable of suppressing the transmission of vibration produced by the engine 16 through the vertical shaft 24 and rotary transmission mechanism 30 to the gear case 22.

Further, the lower end of the exhaust pipe 66 is retained by the extension case 20 through an intervening grommet 76 made of an elastic material (rubber). As can be seen in the drawing, the grommet 76 has a generally conical shape whose upper end is fitted on the lower end region of the exhaust pipe 66 and whose lower end is attached to the extension case 20. The grommet 76 is made of chloroprene rubber having a hardness (elasticity) of a value (e.g., around HS 60°) capable of suppressing the transmission of vibration produced by the engine 16 through the exhaust pipe 66 to the extension case 20.

The outboard motor 10 is equipped with a water pump 80 for supplying pressurized cooling water to the engine 16. The water pump 80 and the engine 16 (more exactly, a coolant passage (not shown) of the engine 16) are connected by a tube 82 made of an elastic material. The water pump 80 comprises, inter alia, an impeller attached to the drive shaft 32. It pumps up sea or lake water present outside the outboard motor 10 and delivers it under pressure to the engine 16. The tube 82 is made of chloroprene rubber having a hardness (elasticity) of a value (e.g., around HS 70°) capable of suppressing the transmission of vibration produced by the engine 16 through the water pump 80 and rotary transmission mechanism 30 (more exactly, the drive shaft 32) to gear case 22.

As set out in the foregoing, the outboard motor 10 according to this invention is configured to have elastic members (the rubber vibration isolators 70, first and second rubber couplings 72, 74, grommet 76, and tube 82) interposed at locations or points where the engine 16 is directly or indirectly connected to the frame of the outboard motor 10 (the mount case 14, extension case 20 and gear case 22). In other words, vibration of the engine 16 transmitting to the frame of the outboard motor 10 is attenuated by the elastic members. Also worth noting is that the air intake pipe and oil pan 60 integrally attached to the engine 16 have no points of connection with the frame of the outboard motor 10.

Thus in the outboard motor 10 according to the foregoing preferred embodiment of this invention, since the rubber vibration isolators 70 are interposed between the engine 16 and the mount case 14 constituting part of the frame of the outboard motor, the transmission of vibration produced by the engine 16 to the frame of the outboard motor 10 is suppressed to reduce outboard motor vibration and noise generated during operation of the engine 16. Moreover, since the locations or points at which the rubber vibration isolators 70 are installed are not in the mounting assembly of the outboard motor 10, the hardness (softness) of the rubber vibration isolators 70 has no effect on the steering performance of the outboard motor 10. The hardness of the rubber vibration isolators 70 can therefore be defined without any particular limitation, which means that it can be defined to optimize the effect of reducing the vibration and noise of the outboard motor 10.

In addition, the crankshaft 16S of the engine and the upper end of the vertical shaft 24 are connected by the first rubber coupling 72, and the lower end of the vertical shaft 24 and the rotary transmission mechanism 30 (more exactly, the upper end of the drive shaft 32) are connected by the second rubber coupling 74. This makes it possible to suppress transmission of vibration produced by the engine 16 to the frame of the outboard motor 10 through the power train. The effect of reducing the vibration and noise of the outboard motor 10 is therefore further enhanced.

The water pump 80 installed for supplying pressurized cooling water to the engine 16 is connected to the engine 16 through the tube 82 made of rubber, thereby suppressing transmission of vibration produced by the engine 16 to the frame of the outboard motor 10 through the engine cooling system and thus further enhancing the effect of reducing the vibration and noise of the outboard motor 10.

The exhaust pipe 66 of the engine 16 is retained by the extension case 20, which is part of the frame of the outboard motor, through the intervening grommet 76 made of rubber. This makes it possible to suppress transmission of vibration produced by the engine 16 to the frame of the outboard motor 10 through the exhaust system. The effect of reducing the vibration and noise of the outboard motor 10 is therefore further enhanced.

As explained above, in accordance with one preferred embodiment of this invention, there is provided an outboard motor (10) adapted to be mounted on a stern of a boat and having an internal combustion engine (16) and a propeller (40) that is powered by the engine to propel the boat, comprising: a frame on which the engine is installed such that a crankshaft (16S) of the engine is parallel to a vertical axis; and an elastic member interposed between the engine and the frame (more exactly, the mount case 14). Specifically, a plurality of the elastic members are provided, which comprise a plurality of vibration isolators (70) made of rubber and each interposed between the engine 16 and the frame at corners, more exactly four corners of the engine 16.

The outboard motor further including: a plurality of the elastic members; a vertical shaft (24) connected to the crankshaft of the engine to rotate about the vertical axis; and a rotary transmission mechanism (30) transmitting a rotation of the vertical shaft (24) to the propeller; and wherein the elastic members comprise: a first elastic coupling (first rubber coupling 72) made of rubber and connecting the crankshaft (16S) of the engine (16) to the vertical shaft (24) and a second elastic coupling (second rubber coupling 74) made of rubber and connecting the vertical shaft (24) to the rotary transmission mechanism (30).

The outboard motor further including: a water pump (80) supplying pressurized cooling water to the engine (16); and wherein the elastic member comprises a tube (82) made of elastic material and connecting the engine (16) to the water pump (80). The tube 80 is made of rubber.

The outboard motor further including: an exhaust pipe (66) exhausting gas generated by the engine (16); and wherein the elastic member comprises a grommet (intervening grommet 76) made of an elastic material retaining the exhaust pipe to the frame (more exactly, the extension case 20). The grommet 76 is made of rubber.

The outboard motor is further configured such that the frame comprises a mount case (14), an extension case (20) fastened to a bottom of the mount case and a gear case (22) fastened to a bottom of the extension case.

It should be noted that the rubber vibration isolators 70 and grommet 76 mentioned in the foregoing can be replaced by springs or other such elastic members. Although the tube 82 is made of rubber, it also can be made of some other material so long as it is a flexible tube (e.g., an accordion tube). Similarly, the first and second rubber couplings 72, 74 can be replaced with other members insofar as they are capable transmitting power and attenuating vibration.

Japanese Patent Application No. 2004-242497 filed on Aug. 23, 2004, from which the present application claims convention priority, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An outboard motor adapted to be mounted on a stern of a boat and having an internal combustion engine and a propeller that is powered by the engine to propel the boat, comprising:

a frame on which the engine is installed such that a crankshaft of the engine is parallel to a vertical axis;

an elastic member interposed between the engine and the frame;

a water pump supplying pressurized cooling water to the engine; and a tube made of elastic material and connecting the engine to the water pump.

2. The outboard motor according to claim 1, wherein the elastic material is rubber.

3. An outboard motor adapted to be mounted on a stern of a boat and having an internal combustion engine and a propeller that is powered by the engine to propel the boat, comprising:

a frame on which the engine is installed such that a crankshaft of the engine is parallel to a vertical axis;

an elastic member interposed between the engine and the frame;

an exhaust pipe exhausting gas generated by the engine; and a grommet retaining the exhaust pipe to the frame.

4. The outboard motor according to claim 3, wherein the grommet is made of rubber.

5. An outboard motor adapted to be mounted on a stern of a boat and having an internal combustion engine and a propeller that is powered by the engine to propel the boat, comprising:

a frame on which the engine is installed such that a crankshaft of the engine is parallel to a vertical axis;

a plurality of elastic members which comprise vibration isolators made of rubber and each interposed between the engine and the frame at corners of the engine;

a vertical shaft connected to the crankshaft of the engine to rotate about the vertical axis;

a rotary transmission mechanism transmitting a rotation of the vertical shaft to the propeller;

a first elastic coupling made of rubber and connecting the crankshaft of the engine to the vertical shaft;

a second elastic coupling made of rubber and connecting the vertical shaft to the rotary transmission mechanism;

a water pump supplying pressurized cooling water to the engine;

a tube made of elastic material and connecting the engine to the water pump;

an exhaust pipe exhausting gas generated by the engine; and an elastic grommet retaining the exhaust pipe to the frame.

6. An outboard motor adapted to be mounted on a stern of a boat and having an internal combustion engine and a propeller that is powered by the engine to propel the boat, comprising:

a frame on which the engine is installed such that a crankshaft of the engine is parallel to a vertical axis;

an elastic member interposed between the engine and the frame; and an air intake pipe and an oil pan attached to the engine, but which are not connected to the frame.

7. An outboard motor adapted to be mounted on a stern of a boat and having an internal combustion engine and a propeller that is powered by the engine to propel the boat, comprising:

a frame on which the engine is installed such that a crankshaft of the engine is parallel to a vertical axis; and a plurality of elastic members interposed between the engine and the frame where the engine and frame are connected;

said elastic members include vibration isolators made of rubber and each interposed between the engine and the frame at corners of the engine;

a water pump supplying pressurized cooling water to the engine; a tube made of elastic material and connecting the engine to the water pump.

8. The outboard motor according to claim 7, wherein the elastic material is rubber.

9. An outboard motor adapted to be mounted on a stern of a boat and having an internal combustion engine and a propeller that is powered by the engine to propel the boat, comprising:

a frame on which the engine is installed such that a crankshaft of the engine is parallel to a vertical axis;

a plurality of elastic members interposed between the engine and the frame where the engine and frame are connected;

said elastic members include vibration isolators made of rubber and each interposed between the engine and the frame at corners of the engine;

an exhaust pipe exhausting gas generated by the engine; and a elastic grommet retaining the exhaust pipe to the frame.

10. The outboard motor according to claim 9, wherein the grommet is made of rubber.

* * * * *